US011315516B2

(12) United States Patent
Xue

(10) Patent No.: US 11,315,516 B2
(45) Date of Patent: Apr. 26, 2022

(54) METHOD OF DRIVING PIXEL DRIVING CIRCUIT SOLVING PROBLEMS OF GREATER POWER CONSUMPTION OF BLUE PHASE LIQUID CRYSTAL PANEL

(71) Applicant: Shenzhen China Star Optoelectronics Semiconductor Display Technology Co., Ltd., Guangdong (CN)

(72) Inventor: Yan Xue, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 9 days.

(21) Appl. No.: 16/757,402

(22) PCT Filed: Mar. 23, 2020

(86) PCT No.: PCT/CN2020/080621
§ 371 (c)(1),
(2) Date: Apr. 19, 2020

(87) PCT Pub. No.: WO2021/164092
PCT Pub. Date: Aug. 26, 2021

(65) Prior Publication Data

US 2021/0256928 A1 Aug. 19, 2021

(51) Int. Cl.
*G09G 3/36* (2006.01)

(52) U.S. Cl.
CPC ..... *G09G 3/3688* (2013.01); *G09G 3/3677* (2013.01); *G09G 2310/08* (2013.01)

(58) Field of Classification Search
CPC ..... G09G 3/30; G09G 3/32; G09G 3/3208; G09G 3/3216; G09G 3/3225; G09G 3/3233; G09G 3/325; G09G 3/3258; G09G 3/3283; G09G 3/3291; G09G 3/36; G09G 3/3622; G09G 3/3625; G09G 3/3674; G09G 3/3677; G09G 3/3681; G09G 3/3685; G09G 3/3688; G09G 3/3692
USPC ..... 345/76–83, 87–104
See application file for complete search history.

(56) References Cited

U.S. PATENT DOCUMENTS

| | | | | |
|---|---|---|---|---|
| 11,107,401 | B1 * | 8/2021 | Xue | G09G 3/3233 |
| 2005/0052377 | A1 | 3/2005 | Hsueh | |
| 2005/0057456 | A1 * | 3/2005 | Hu | G09G 3/325 345/76 |
| 2007/0115225 | A1 * | 5/2007 | Uchino | G09G 3/3233 345/76 |
| 2014/0139510 | A1 * | 5/2014 | Han | G09G 3/3233 345/212 |

(Continued)

FOREIGN PATENT DOCUMENTS

| | | | |
|---|---|---|---|
| CN | 103680406 | A | 3/2014 |
| CN | 104299573 | A | 1/2015 |

(Continued)

*Primary Examiner* — Alexander Eisen
*Assistant Examiner* — Nelson Lam
(74) *Attorney, Agent, or Firm* — Mark M. Friedman

(57) ABSTRACT

A pixel driving circuit, a method of driving the pixel driving circuit, and a display panel. The pixel driving circuit includes a first transistor T1, a second transistor T2, a third transistor T3, a fourth transistor T4, a bootstrap capacitor Cbt, a storage capacitor Cst, and a light-emitting element D.

8 Claims, 6 Drawing Sheets

(56) References Cited

U.S. PATENT DOCUMENTS

| | | | | |
|---|---|---|---|---|
| 2015/0103060 | A1* | 4/2015 | Yamashita | G09G 3/3266 345/211 |
| 2015/0339973 | A1 | 11/2015 | Wu et al. | |
| 2015/0379929 | A1* | 12/2015 | Zhai | G09G 3/3233 345/78 |
| 2016/0148578 | A1* | 5/2016 | Kishi | G09G 3/3291 345/212 |
| 2016/0372040 | A1 | 12/2016 | Huangfu et al. | |
| 2017/0154591 | A1 | 6/2017 | Hung et al. | |
| 2019/0066587 | A1* | 2/2019 | Han | H01L 27/1218 |
| 2019/0074340 | A1 | 3/2019 | Cai | |
| 2019/0266950 | A1 | 8/2019 | Xu | |

FOREIGN PATENT DOCUMENTS

| | | | |
|---|---|---|---|
| CN | 105679264 | A | 6/2016 |
| CN | 107316614 | A | 11/2017 |
| CN | 107342052 | A | 11/2017 |
| CN | 108335671 | A | 7/2018 |
| CN | 109979384 | A | 7/2019 |
| CN | 110349534 | A | 10/2019 |

* cited by examiner

METHOD OF DRIVING PIXEL DRIVING CIRCUIT SOLVING PROBLEMS OF GREATER POWER CONSUMPTION OF BLUE PHASE LIQUID CRYSTAL PANEL

FIELD OF INVENTION

The present disclosure relates to the field of display technologies, and more particularly, to a pixel driving circuit, a method of driving the pixel driving circuit, and a display panel.

BACKGROUND OF INVENTION

Blue phase liquid crystals have the advantages of sub-millimeter response times, simple manufacturing process, and wide viewing angles, and has attracted more and more researchers' attention worldwide. However, the most important feature of the blue phase liquid crystals is that they needs a high voltage to drive the liquid crystal molecules. The high voltage is greater than 30V. According to a calculation formula of the dynamic power consumption of the panel $p=fcV^2$, the dynamic power consumption changes exponentially with the data voltage. Therefore, a data line of the conventional blue-phase liquid crystal pixel circuit obtained a higher voltage, that is, VData1>30V and the blue-phase liquid crystal panel requires greater power consumption.

At the same time, the blue phase liquid crystal panel pixel circuit generally uses a 3T1C circuit structure. This circuit structure has a poor effect of compensating the threshold voltage Vth, which causes the threshold voltage Vth negative and a difficulty of saving the data voltage stably in the storage capacitor. Therefore, the data signal will be gradually lost, causes the screen to flicker and affected product quality.

SUMMARY OF INVENTION

The purpose of the present disclosure is to provide a pixel driving circuit, a method of driving the pixel driving circuit, and a display panel to solve the technical problems of greater power consumption of the blue phase liquid crystal panel and severe data signal loss caused by bad threshold voltage Vth compensation effect.

To achieve the above object, the present disclosure provides a pixel driving circuit, including: a first transistor T1, a second transistor T2, a third transistor T3, a fourth transistor T4, a bootstrap capacitor Cbt, a storage capacitor Cst, and a light-emitting element D. Specifically, a gate of the first transistor T1 is connected to a first node G, a source of the first transistor T1 is connected to a second node S, and a drain of the first transistor T1 is connected to a power supply voltage VDD. A gate of the second transistor T2 is connected to a first scan signal Scan1, a source of the second transistor T2 is connected to a data signal Data1, and a drain of the second transistor T2 is connected to the first node G. A gate of the third transistor T3 is connected to the first scan signal Scan1, a source of the third transistor T3 is connected to a sensing signal Ref, and a drain of the third transistor T3 is connected to the second node S. A gate of the fourth transistor T4 is connected to the second scan signal Scan2, a source of the fourth transistor T4 is connected to the second node S, and a drain of the fourth transistor T4 is connected to a third node M. One terminal of the bootstrap capacitor Cbt is connected to the first node G, and another terminal of the bootstrap capacitor is connected to the second node S. One terminal of the storage capacitor Cst is connected to the third node M, and another terminal of the storage capacitor is connected to a ground voltage VSS. An anode of the light-emitting element D is connected to the third node M, and a cathode of the light-emitting element is connected to a common voltage signal Tcom.

Further, each of the first transistor T1, the second transistor T2, the third transistor T3, and the fourth transistor T4 is one of a low temperature polysilicon transistor, an oxide semiconductor transistor, or an amorphous silicon transistor.

Further, the first scan signal Scan1 and the second scan signal Scan2 are both provided by an external timing controller.

Further, when the second scan signal Scan2 drops from a high voltage to a low voltage, the fourth transistor T4 is turned off, and the storage capacitor Cst provides a constant driving current to the light-emitting element D.

To achieve the above object, the present disclosure further provides a method of driving a pixel driving circuit, and including the following steps:

- initializing the pixel driving circuit in an initialization phase;
- detecting a threshold voltage of the first transistor T1 and saving the threshold voltage Vth in the storage capacitor Cst in a data input detection phase; and
- generating a driving current by the storage capacitor Cst and providing the driving current to the light-emitting element D for driving the light-emitting element D to emit light and to display in a light-emitting phase.

Further, the data input stage includes steps:

- in the first stage, the first scan signal Scan1, the power voltage VDD, the data signal Data1, and the sensing signal Ref obtaining a high electrical potential, turning on the first transistor T1, the second transistor T2, and the third transistors T3, and charging the bootstrap capacitor Cbt; and
- in a second stage, reducing the first scan signal Scan1 from the high potential to a low potential, the second scan signal Scan2 obtaining the high electrical potential, turning off the second transistor T2 and the third transistor T3 and at the same time turning on the fourth transistor T4, raising potentials of the first node G, the second node S, and the third node M to a driving voltage, and charging the storage capacitor Cst.

Further, a voltage of the data signal Data1 ranges from 1V to 10V; and/or, a voltage of the sensing signal Ref is 1V; and/or, the power supply voltage VDD is 30V; and/or, the driving voltage is 30V.

Further, when entering the light-emitting phase from the input detection phase, the second scan signal Scan2 is reduced from the high electrical potential to the low electrical potential, the fourth transistor T4 is turned off, the storage capacitor Cst provides a constant driving current to the light-emitting element D, and the light-emitting element D emits light continuously.

Further, in the light-emitting stage, the first scan signal Scan1, the second scan signal Scan2, and the data signal Data1 all acquire a low potential, and the light-emitting element D emits light.

A display panel includes the pixel driving circuit described above.

The technical effect of the present disclosure is to provide a pixel driving circuit, a method of driving the pixel driving circuit, and a display panel. By reasonably adding the fourth transistor T4 and the storage capacitor Cst, transmitting the power supply voltage VDD to the third node N and saved in the storage capacitor Cst, then turning off the fourth transistor T4, the storage capacitor Cst provides a constant driving current to the light-emitting element D, which can significantly reduce the voltage of the data signal Data1, thereby achieving the purpose of low power consumption. In addition, the pixel driving circuit has a threshold voltage Vth compensation effect, and the Vdata voltage only needs to be maintained at 10V, which is conducive to improve brightness uniformity.

DESCRIPTION OF DRAWINGS

In reference to the figures, the specific embodiments of the present disclosure will be described in detail below, so that the technical solution and other beneficial effects of the present disclosure can become obvious.

DETAILED DESCRIPTION OF PREFERRED EMBODIMENTS

In the following, the technical solutions in the embodiments of the present disclosure will be clearly and completely described with reference to the figures. Obviously, the described embodiments are only some embodiments of the present disclosure, not all the embodiments. Based on the embodiments in the present disclosure, all other embodiments obtained by a person of ordinary skill in the art without creative steps shall fall within the protection scope of the present disclosure.

In the description of the present disclosure, it should be noted that the terms "installation", "linked", and "connected" should be understood in a broad sense unless explicitly stated and limited otherwise. For example, it can be fixed connection, removable connection, or integral connection; it can be mechanical or electrical connection; it can be directly connected, indirectly connected through an intermediate medium, or it can be an internal communication of two elements. For those of ordinary skill in the art, the specific meanings of the above terms in the present disclosure can be understood on a case-by-case basis.

Figure 1:
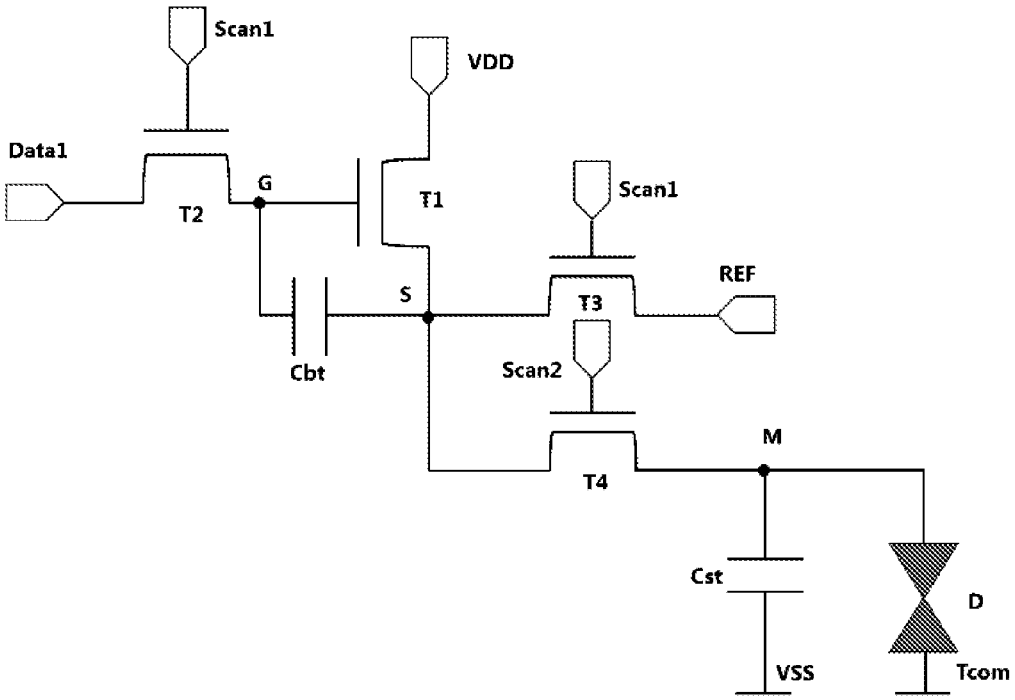
FIG. 1 is a schematic structural diagram of a pixel driving circuit according to one embodiment of the present disclosure.

As shown in FIG. 1, this embodiment provides a pixel driving circuit having a 4T2C structure, which includes a first transistor T1, a second transistor T2, a third transistor T3, a fourth transistor T4, a bootstrap capacitor Cbt, a storage capacitor Cst, and a light-emitting element D. Specifically, a gate of the first transistor T1 is connected to a first node G, a source of the first transistor T1 is connected to a second node S, and a drain of the first transistor T1 is connected to a power supply voltage VDD. A gate of the second transistor T2 is connected to a first scan signal Scan1, a source of the second transistor T2 is connected to a data signal Data1, and a drain of the second transistor T2 is connected to the first node G. A gate of the third transistor T3 is connected to the first scan signal Scan1, a source of the third transistor T3 is connected to a sensing signal Ref, and a drain of the third transistor T3 is connected to the second node S. A gate of the fourth transistor T4 is connected to the second scan signal Scan2, a source of the fourth transistor T4 is connected to the second node S, and a drain of the fourth transistor T4 is connected to a third node M. One terminal of the bootstrap capacitor Cbt is connected to the first node G, and another terminal of the bootstrap capacitor is connected to the second node S. One terminal of the storage capacitor Cst is connected to the third node M, and another terminal of the storage capacitor is connected to a ground voltage VSS. An anode of the light-emitting element D is connected to the third node M, and a cathode of the light-emitting element is connected to a common voltage signal Tcom.

Specifically, the power supply voltage VDD is at high electrical potential, and the ground voltage VSS is at low electrical potential.

The first transistor T1 is a driving transistor and provides a constant driving current to the light-emitting element D.

The second transistor T2 is a switching transistor, the gate of the second transistor T2 connected to the first scanning signal Scan1, the source of the second transistor T2 connected to the data signal Data1, and the drain of the second transistor T2 connected to the first node G. The second transistor T2 is electrically connected to the first transistor T1 and the bootstrap capacitor Cbt. The first scan signal Scan1 is provided by an external timing controller.

The bootstrap capacitor Cbt is connected between the first node G and the second node S, and maintaining a predetermined voltage within a frame time.

The light-emitting element D is a liquid crystal.

In this embodiment, by reasonably adding the fourth transistor T4 and the storage capacitor Cst, transmitting the power supply voltage VDD to the third node N and saved in the storage capacitor Cst, then turning off the fourth transistor T4, the storage capacitor Cst provides a constant driving current to the light-emitting element D, which can significantly reduce a voltage of the data signal Data1, thereby achieving the purpose of low power consumption, in addition, this embodiment also has a threshold voltage Vth compensation effect, and is conducive to improve brightness uniformity.

In this embodiment, each of the first transistor T1, the second transistor T2, the third transistor T3, and the fourth transistor T4 is one of a low temperature polysilicon transistor, an oxide semiconductor transistor, or an amorphous silicon transistor. The first scan signal Scan1 and the second scan signal Scan2 are provided by an external timing controller.

Figure 2:
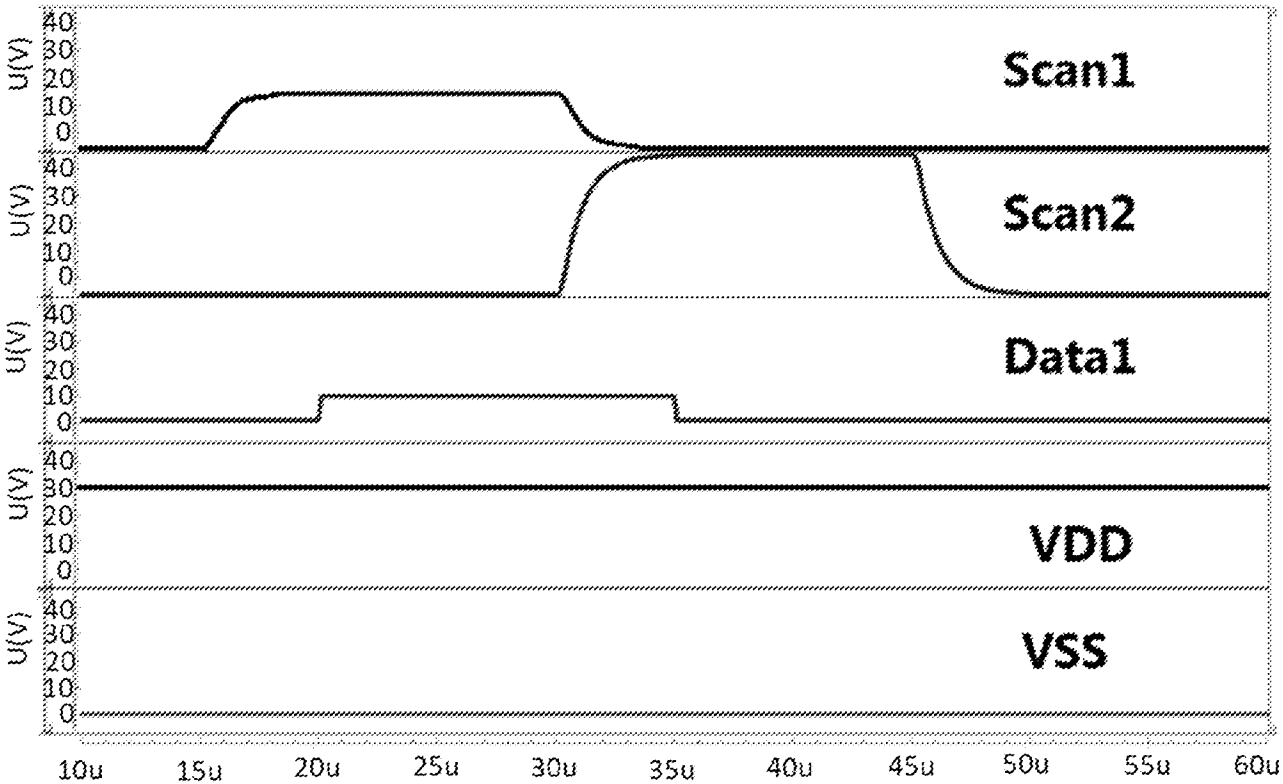
FIG. 2 is a timing diagram of an input source signal of the pixel driving circuit according to one embodiment of the present disclosure.
Figure 3:
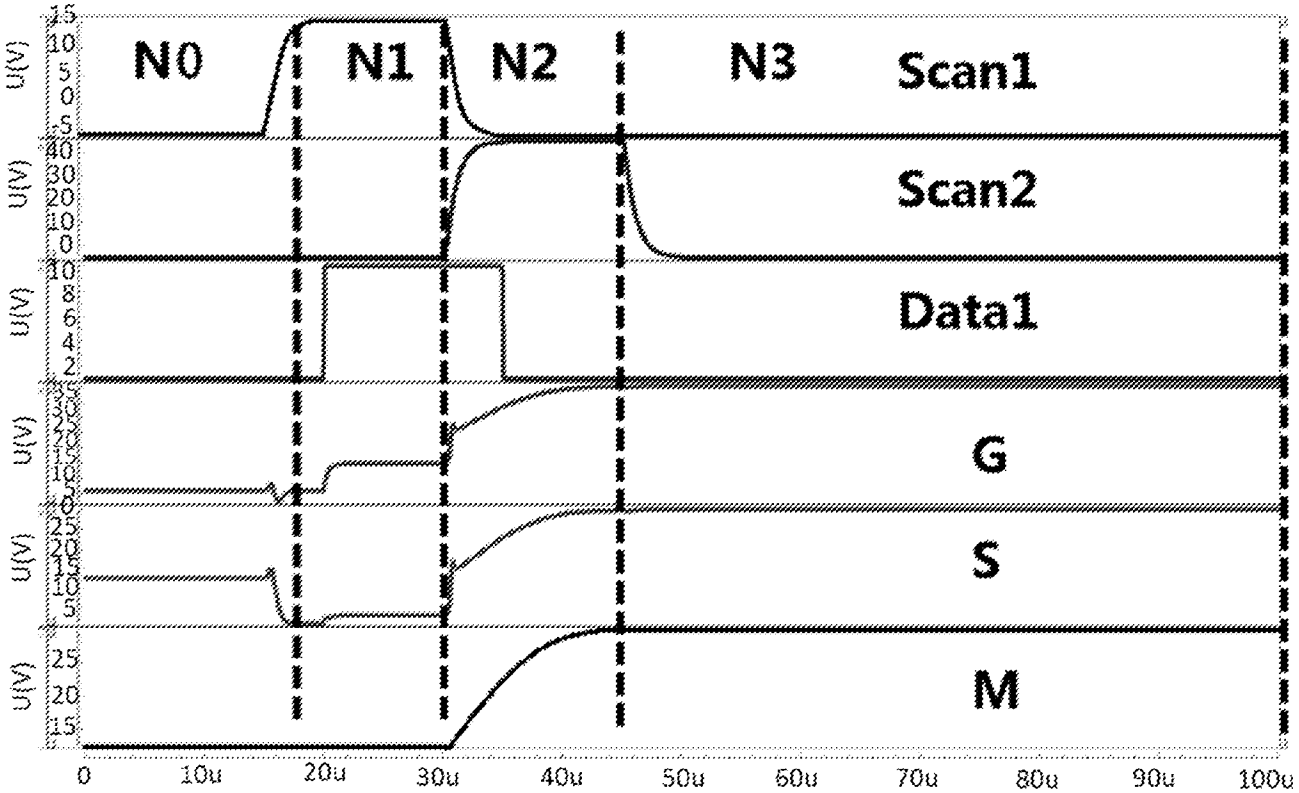
FIG. 3 is a schematic diagram of an output waveform of the pixel driving circuit according to one embodiment of the present disclosure.
Figure 4:
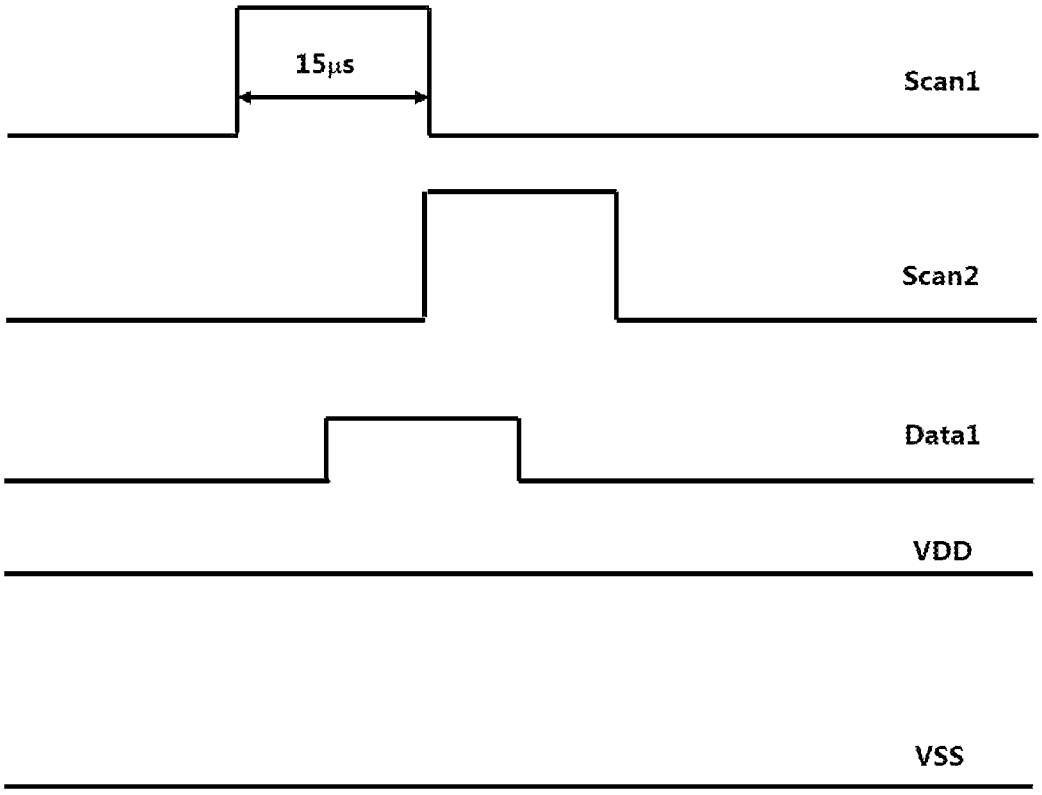
FIG. 4 is a driving timing diagram of the pixel driving circuit according to one embodiment of the present disclosure.
Figure 5:
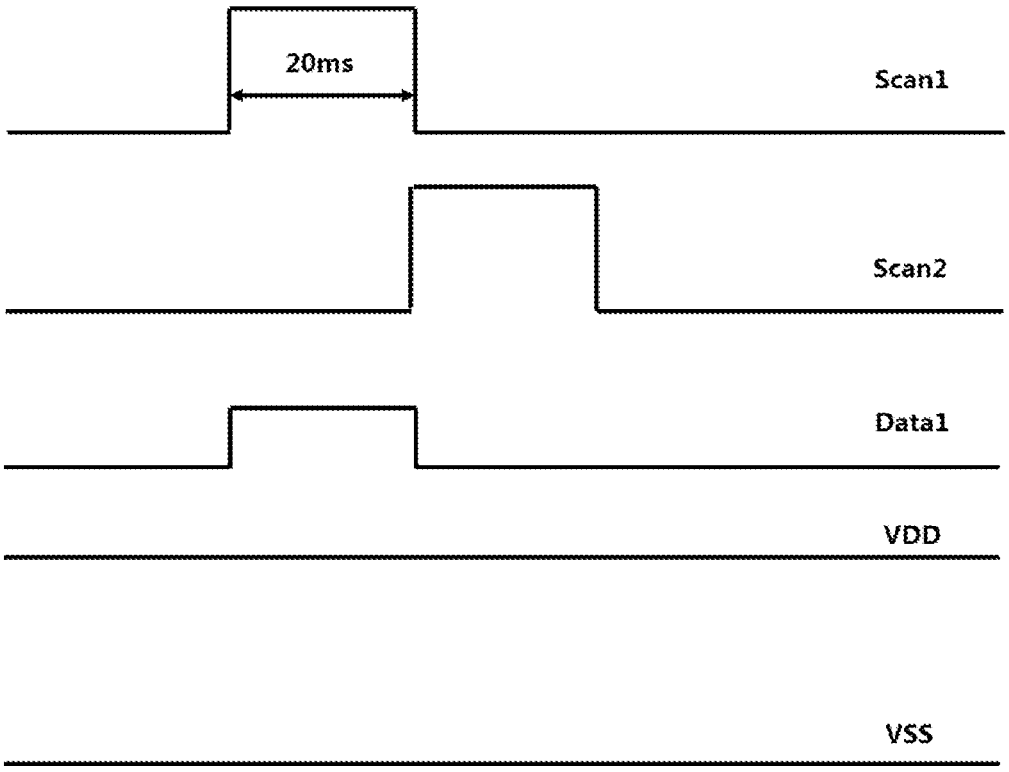
FIG. 5 is a compensation timing diagram of the pixel driving circuit according to one embodiment of the present disclosure.

This embodiment also provides a method of driving the pixel driving circuit, which includes the pixel driving circuit described above. FIG. 2 is a timing diagram of an input source signal of the pixel driving circuit according to one embodiment of the present disclosure. FIG. 3 is a schematic diagram of an output waveform of the pixel driving circuit according to one embodiment of the present disclosure. FIG. 4 is a driving timing diagram of the pixel driving circuit according to one embodiment of the present disclosure. FIG. 5 is a compensation timing diagram of the pixel driving circuit according to one embodiment of the present disclosure.

Specifically, in conjunction form FIG. 2 to FIG. 5, the method of driving the pixel driving circuit includes the following steps:

initializing the pixel driving circuit in an initialization phase N0;

detecting a threshold voltage of the first transistor T1 and saving the threshold voltage Vth in the storage capacitor Cst in a data input detection phase; and generating a driving current by the storage capacitor Cst and providing the driving current to the light-emitting element D for driving the light-emitting element D to emit light and to display in a light-emitting phase N3.

Figure 6:
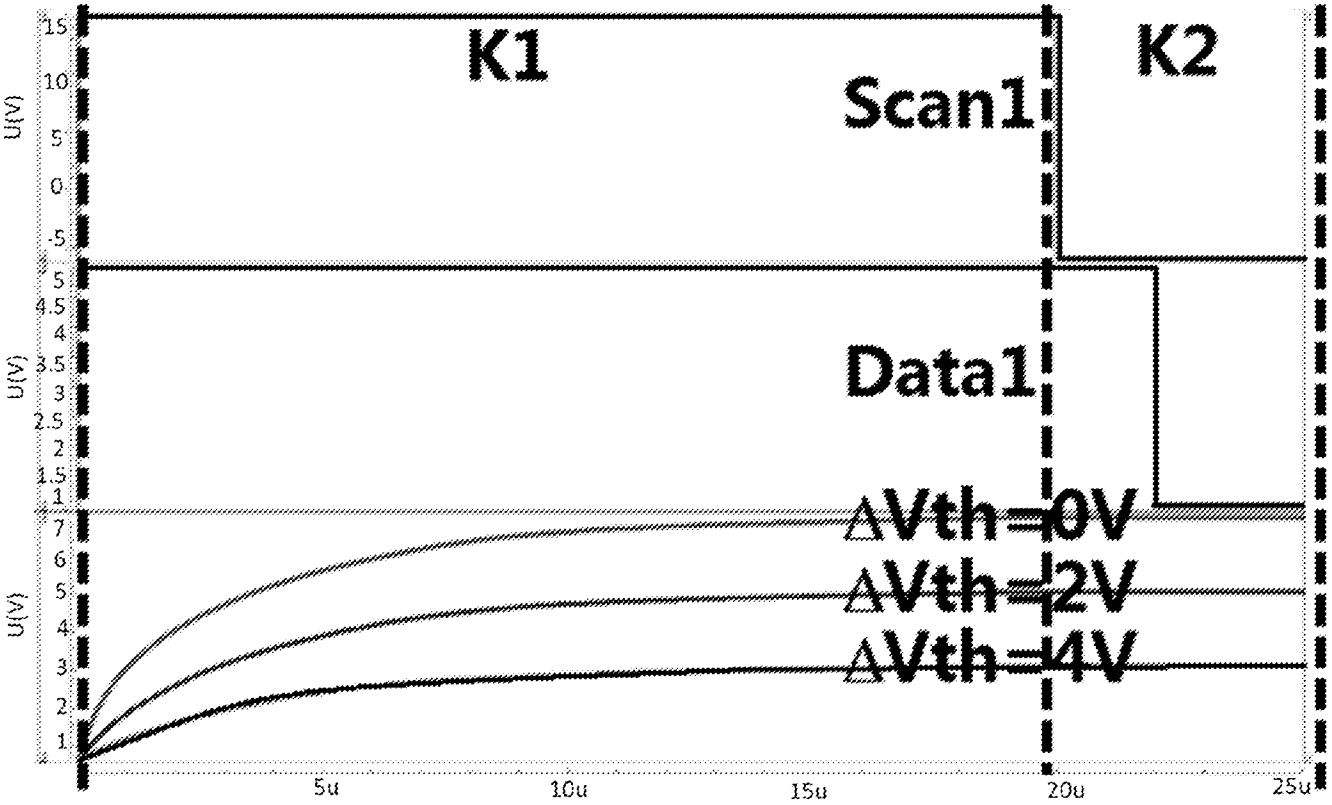
FIG. 6 is a schematic diagram of detecting a threshold voltage negative bias (ΔVth) of the pixel driving circuit according to one embodiment of the present disclosure.

The detected threshold voltage of the first transistor T1 is $V_{data1}$−Vth. Based on the compensation timing chart shown in FIG. 5, the negative offsets (ΔVth) of the threshold voltage Vth are respectively simulated to be 0, 2V, and 4V, the voltage detected by the sensing signal Ref is specifically shown in FIG. 6, FIG. 6 is a schematic diagram of detecting a threshold voltage negative bias (ΔVth) of the pixel driving circuit according to one embodiment of the present disclosure.

In this embodiment, in the data input detection phase N1, N2, the first scan signal Scan1, the second scan signal Scan2, the data signal Data1, and the sensing signal Ref obtaining a high electrical potential, turning on the first transistor T1, the second transistor T2, and the third transistor T3, and charging the bootstrap capacitor Cbt.

In this embodiment, the data input detection phase includes steps N1 and N2:

In a first stage N1, the first scan signal Scan1, the power supply voltage VDD, the data signal Data1, and the sensing signal Ref obtaining a high electrical potential, turning on the first transistor T1, the second transistor T2, and The third transistors T3, and charging the bootstrap capacitor Cbt; at this time, the first transistor T1 operates in a saturation region, and its gate voltage Vgs=9V; and In a second stage N2, reducing the first scan signal Scan1 from the high electrical potential to a low electrical potential, the second scan signal Scan2 obtaining the high electrical potential, turning off the second transistor T2 and the third transistor T3 and at the same time turning on the fourth transistor T4, raising potentials of the first node G, the second node S, and the third node M to a driving voltage, and charging the storage capacitor Cst.

According to $I=1/2*C*\mu*W/L*(Vgs-Vref)^2$, it can be known that the increased electrical potential of the second node S is independent of the threshold voltage Vth.

In this embodiment, a voltage of the data signal Data1 ranges from 1V to 10V; and/or a voltage of the sensing signal Ref is 1V; and/or the power supply voltage VDD is 30V; and/or, the driving voltage is 30V.

Specifically, the specific waveform and electrical potential relationship of each signal in the pixel driving circuit can be shown in Table 1 below.

TABLE 1

| | Voltage setting | |
|---|---|---|
| GOA signal | Minimum (volts) | Maximum (volts) |
| Data1 | +1 | +10 |
| Scan1 | −6 | +15 |
| Scan2 | −6 | +50 |
| Ref | +1 | |
| VDD | +30 | |
| VSS | 0 | |

When the power is turned on, the first scan signal Scan1 rises to the high electrical potential, and the voltage of the data signal Data1 becomes Vdata+Vth, that is, from 1V to 10V, and a conversion amount is a highest gate voltage Vgs=9V of the first transistor T1 operated in the saturation region.

In this embodiment, when entering the light-emitting phase N3 from the input detection phase N1 and N2, the second scan signal Scan2 is reduced from the high electrical potential to the low electrical potential, the fourth transistor T4 is turned off, the storage capacitor Cst provides a constant driving current to the light-emitting element D, and the light-emitting element D emits light continuously.

Further, in the light-emitting stage, the first scan signal Scan1, the second scan signal Scan2, and the data signal Data1 all obtain the low electrical potential, and the light-emitting element D emits light.

FIG. 6 is a schematic diagram of detecting a threshold voltage negative bias (ΔVth) of the pixel driving circuit of the embodiment, which mainly shows an output waveform of the influence of the first transistor T1 threshold voltage negative bias (ΔVth) on the current flowing through the light-emitting element D. At the K1 stage, the threshold voltage negative deviation (ΔVth) occurs, during the K2 stage, the bootstrap capacitor Cbt discharge compensates for the threshold voltage negative deviation (ΔVth), the threshold voltage Vth is pulled up and raised to a stable high electrical potential. It can be seen that, in this embodiment, by reasonably adding the fourth transistor T4 and the storage capacitor Cst, transmitting the power supply voltage VDD to the third node N and saved in the storage capacitor Cst, then turning off the fourth transistor T4, the storage capacitor Cst provides a constant driving current to the light-emitting element D, which can significantly reduce the voltage of the data signal Data1, thereby achieving the purpose of low power consumption. In addition, the pixel driving circuit has a threshold voltage Vth compensation effect, and the Vdata voltage only needs to be maintained at 10V, which is conducive to improve brightness uniformity.

In the embodiments of the present disclosure, wherein the dynamic power consumption of the data line is $p=fcVdata1^2$, and Vdata1 is the voltage of the data signal Data1, which is 10V. If uses the pixel structure of the conventional liquid crystal display 1T1C, the dynamic power consumption of the data line is $p=fcVdata^2$, the voltage of Vdata is 30V, and the power consumption varies greatly. Therefore, the present disclosure achieves the purpose of low power consumption.

An embodiment of the present disclosure further provides a display panel including the pixel driving circuit described above.

The technical effect of the present disclosure is to provide a pixel driving circuit, a method of driving the pixel driving circuit, and a display panel. By reasonably adding the fourth transistor T4 and the storage capacitor Cst, transmitting the power supply voltage VDD to the third node N and saved in the storage capacitor Cst, then turning off the fourth transistor T4, the storage capacitor Cst provides a constant driving current to the light-emitting element D, which can significantly reduce the voltage of the data signal Data1, thereby achieving the purpose of low power consumption. In addition, the pixel driving circuit has a threshold voltage Vth compensation effect, and the Vdata voltage only needs to be maintained at 10V, which is conducive to improve brightness uniformity.

In the above embodiments, the description of each embodiment has its emphasis. For a part that is not described in detail in one embodiment, reference may be made to related descriptions in other embodiments.

The description above providing and describing embodiments of the pixel driving circuit and driving method thereof, and a display panel in detail to explain the principles and implementation of the present disclosure. The description of the above embodiments is only used to help understand the technical solution and core idea of the present disclosure. It should be noted that, for those of ordinary skill in the art, without departing from the principle of the present disclosure, several improvements and retouches can be made, and these improvements and retouches are within the protection scope of the present disclosure.

What is claimed is:

1. A method of driving a pixel driving circuit, the pixel driving circuit comprising:

a first transistor, wherein a gate of the first transistor is connected to a first node, a source of the first transistor is connected to a second node, and a drain of the first transistor is connected to a power supply voltage;

a second transistor, wherein a gate of the second transistor is connected to a first scan signal, a source of the second transistor is connected to a data signal, and a drain of the second transistor is connected to the first node;

a third transistor, wherein a gate of the third transistor is connected to the first scanning signal, a source of the third transistor is connected to a sensing signal, and a drain of the third transistor is connected to the second node;

a fourth transistor, wherein a gate of the fourth transistor is connected to a second scan signal, a source of the fourth transistor is connected to the second node, and a drain of the fourth transistor is connected to a third node;

a bootstrap capacitor, wherein one terminal of the bootstrap capacitor is connected to the first node, and another terminal of the bootstrap capacitor is connected to the second node;

a storage capacitor, wherein one terminal of the storage capacitor is connected to the third node, and another terminal of the storage capacitor is connected to a ground voltage; and a light-emitting element, wherein an anode of the light-emitting element is connected to the third node, and a cathode of the light-emitting element is connected to a common voltage signal;

wherein the method of driving the pixel driving circuit comprises the steps including:

initializing the pixel driving circuit in an initialization phase;

detecting a threshold voltage of the first transistor and saving the threshold voltage in the storage capacitor in a data input detection phase; and generating a driving current by the storage capacitor and providing the driving current to the light-emitting element for driving the light-emitting element to emit light and to display in a light-emitting phase.

2. The method of driving the pixel driving circuit as claimed in claim 1, wherein the data input detection phase comprises the steps of:

in a first stage, the first scan signal, the data signal, the power supply voltage, and the sensing signal obtaining a high electrical potential, turning on the first transistor, the second transistor, and the third transistor, and charging the bootstrap capacitor; and in a second stage, reducing the first scan signal from the high electrical potential to a low electrical potential, the second scan signal obtaining the high electrical potential, turning off the second transistor and the third transistor and at a same time turning on the fourth transistor, raising potentials of the first node, the second node, and the third node to a driving voltage, and charging the storage capacitor.

3. The method of driving the pixel driving circuit as claimed in claim 2, wherein a voltage of the data signal ranges from 1V to 10V; and/or a voltage of the sensing signal is 1V; and/or, the power supply voltage is 30V; and/or, the driving voltage is 30V.

4. The method of driving the pixel driving circuit as claimed in claim 2, wherein in the light-emitting phase, the first scan signal, the second scan signal, and the data signal all obtain the low electrical potential, and the light-emitting element emits light.

5. The method of driving the pixel driving circuit as claimed in claim 1, wherein when entering the light-emitting phase from the input detection phase, the second scan signal is reduced from the high electrical potential to the low electrical potential, the fourth transistor is turned off, the storage capacitor provides a constant driving current to the light-emitting element, and the light-emitting element emits light continuously.

6. The method of driving the pixel driving circuit as claimed in claim 1, wherein each of the first transistor, the second transistor, the third transistor, and the fourth transistor is one of a low temperature polysilicon transistor, an oxide semiconductor transistor, or an amorphous silicon transistor.

7. The method of driving the pixel driving circuit as claimed in claim 1, wherein the first scan signal and the second scan signal are both provided by an external timing controller.

8. The method of driving the pixel driving circuit as claimed in claim 1, wherein when the second scan signal drops from a high voltage to a low voltage, the fourth transistor is turned off, and the storage capacitor provides a constant driving current to the light-emitting element.

* * * * *